US009970455B2

(12) United States Patent
Cho et al.

(10) Patent No.: US 9,970,455 B2
(45) Date of Patent: May 15, 2018

(54) COMPRESSOR

(71) Applicant: Hanwha Power Systems Co., Ltd., Gyeongsangnam-do (KR)

(72) Inventors: Jongjae Cho, Changwon-si (KR); Yeonhwa Cho, Changwon-si (KR); Bonggun Shin, Changwon-si (KR); Kangsoo Im, Changwon-si (KR)

(73) Assignee: HANWHA POWER SYSTEMS CO., LTD., Gyeongsangnam-do (KR)

( * ) Notice: Subject to any disclaimer, the term of this patent is extended or adjusted under 35 U.S.C. 154(b) by 250 days.

(21) Appl. No.: 14/799,838

(22) Filed: Jul. 15, 2015

(65) Prior Publication Data

US 2016/0230775 A1 Aug. 11, 2016

(30) Foreign Application Priority Data

Feb. 5, 2015 (KR) ..... 10-2015-0018133

(51) Int. Cl.
*F04D 29/42* (2006.01)
*F04D 29/46* (2006.01)
*F04D 29/44* (2006.01)

(52) U.S. Cl.
CPC ..... *F04D 29/4206* (2013.01); *F04D 29/441* (2013.01); *F04D 29/444* (2013.01); *F04D 29/462* (2013.01)

(58) Field of Classification Search
CPC ..... F04D 29/44; F04D 29/41; F04D 29/444; F01D 9/026
See application file for complete search history.

(56) References Cited

U.S. PATENT DOCUMENTS 4,382,747 A * 5/1983 Okano ..... F01D 25/166 415/207
4,932,835 A * 6/1990 Sorokes ..... F04D 29/462 415/150
5,722,813 A * 3/1998 Li ..... F04D 29/083 415/208.1
6,193,463 B1 2/2001 Adeff et al.
6,669,436 B2 * 12/2003 Liu ..... F04D 29/665 181/286
8,567,190 B2 * 10/2013 Sumser ..... F04D 25/06 123/559.1
2011/0318182 A1 * 12/2011 Jeong ..... F04D 29/462 416/183

(Continued)

FOREIGN PATENT DOCUMENTS

GB 701560 A * 12/1953 ..... F04D 29/441
JP 2000-291593 A 10/2000

(Continued)

*Primary Examiner* — Dwayne J White
*Assistant Examiner* — Topaz L Elliott
(74) *Attorney, Agent, or Firm* — Ladas & Parry LLP

(57) ABSTRACT

A compressor includes a housing; an impeller rotatably installed in the housing; a guidance unit connected to the housing at a first end of the guidance unit and configured to guide a fluid discharged by the impeller, the guidance unit configured to change a flow direction; and a scrolling unit connected to a second end opposite to the first end of the guidance unit. A width of an opening via which the fluid enters a circular space of the scrolling unit is about 1.5 to about 3.5 times a height of the guidance unit.

6 Claims, 4 Drawing Sheets

(56) References Cited

U.S. PATENT DOCUMENTS

| | | | | |
|---|---|---|---|---|
| 2012/0020776 | A1* | 1/2012 | Colson | F04D 29/462<br>415/150 |
| 2012/0171030 | A1* | 7/2012 | Iino | F04D 29/541<br>415/211.2 |
| 2016/0076553 | A1* | 3/2016 | Bessho | F04D 25/024<br>415/204 |
| 2016/0108920 | A1* | 4/2016 | Yamashita | F04D 29/441<br>415/204 |

FOREIGN PATENT DOCUMENTS

| | | | |
|---|---|---|---|
| KR | 2002-0020922 | A | 3/2002 |
| KR | 10-2006-0056738 | A | 5/2006 |
| KR | 10-0619790 | B1 | 9/2006 |

* cited by examiner

COMPRESSOR

CROSS-REFERENCE TO RELATED APPLICATION

This application claims priority from Korean Patent Application No. 10-2015-0018133, filed on Feb. 5, 2015, in the Korean Intellectual Property Office, the disclosure of which is incorporated herein by reference in its entirety.

BACKGROUND

1. Field

Apparatuses consistent with exemplary embodiments relate to a compressor.

2. Description of the Related Art

A compressor compresses a fluid provided from the outside and provides the compressed fluid to the outside or an external device. The compressor may generally include a housing, an impeller rotatably installed in the housing, and a scrolling unit configured to guide a fluid compressed via the impeller.

In a compressor of the related art described above, pressure loss may occur until the compressed fluid is provided to the scrolling unit. The pressure loss could have a negative impact on the performance of the compressor. Therefore, various types of compressors have been developed and research into compressors has been conducted to solve the above-described problem of the pressure loss. In particular, research into types of scrolling units, housings, passages via which a fluid flows from a housing to a scrolling unit, etc. has been conducted, and various such products have been developed.

For example, Korean patent publication 0619790 discloses a technology for optimizing a flow path like the above-described compressor.

SUMMARY

One or more exemplary embodiments include a compressor.

Additional aspects will be set forth in part in the description which follows and, in part, will be apparent from the description, or may be learned by practice of the presented exemplary embodiments.

According to an aspect of an exemplary embodiment, there is provided a compressor including: a housing; an impeller rotatably installed in the housing; a guidance unit configured to guide a fluid discharged by the impeller; and a scrolling unit connected to the guidance unit so that a flow direction of the fluid changes due to a curvature of the guidance unit. A width of an opening via which the fluid enters a circular space in the scrolling unit is about 1.5 to about 3.5 times a height of the guidance unit.

The compressor may further include a diffuser rotatably installed in the guidance unit.

A first length from a rotation center of the impeller to a point where the guidance unit is bent may be about 1.15 to about 1.3 times greater than a second length from the rotation center of the impeller to a trailing edge of the diffuser.

According to an aspect of another exemplary embodiment, there is provided compressor including: a housing; an impeller rotatably installed in the housing; a guidance unit connected to the housing at a first end of the guidance unit and configured to guide a fluid discharged by the impeller, the guidance unit configured to change a flow direction; and a scrolling unit connected to a second end opposite to the first end of the guidance unit, wherein a width of an opening via which the fluid enters a circular space of the scrolling unit is about 1.5 to about 3.5 times a height of the guidance unit.

A first length corresponding to a length from a rotation center of the impeller to a point where the guidance unit is bent may be about 1.15 to about 1.3 times greater than a second length corresponding to a length from the rotation center of the impeller to a trailing edge of the diffuser.

The diffuser may include a blade including a trailing edge.

A first length corresponding to a length from a rotation center of the impeller to a point where the guidance unit is bent may be about 1.15 to about 1.3 times greater than a second length corresponding to a length from the rotation center of the impeller to the trailing edge of the blade.

The width of the opening may extend in a radial direction of the compressor and the height of the guidance unit may extend in an axial direction of the compressor.

The guidance unit may include: a first guidance unit extending in a radial direction; and a second guidance unit connected to the first guidance unit and extending substantially perpendicularly from the first guidance unit, the second guidance unit connected to the scrolling unit, wherein the opening corresponds to the second guidance unit and the height corresponds to the height of the first guidance unit.

BRIEF DESCRIPTION OF THE DRAWINGS

The above and/or other aspects of the disclosure will become apparent and more readily appreciated from the following description of the exemplary embodiments, taken in conjunction with the accompanying drawings in which.

DETAILED DESCRIPTION

The inventive concept will now be described more fully with reference to the accompanying drawings, in which exemplary embodiments of the inventive concept are shown. The inventive concept may, however, be embodied in many different forms and should not be construed as being limited to the exemplary embodiments set forth herein; rather, these exemplary embodiments are provided so that this inventive concept will be thorough and complete, and will fully convey the concept of the inventive concept to those skilled in the art. The terms used in the present specification are merely used to describe particular exemplary embodiments, and are not intended to limit the inventive concept. An expression used in the singular encompasses the expression of the plural, unless it has a clearly different meaning in the context. In the present specification, it is to be understood that the terms such as "including", "having", and "comprising" are intended to indicate the existence of the features, numbers, steps, actions, components, parts, or combinations thereof disclosed in the specification, and are not intended to preclude the possibility that one or more other features, numbers, steps, actions, components, parts, or combinations thereof may exist or may be added. While such terms as "first", "second", etc., may be used to describe various components, such components must not be limited to the above terms. The above terms are used only to distinguish one component from another.

Figure 1:
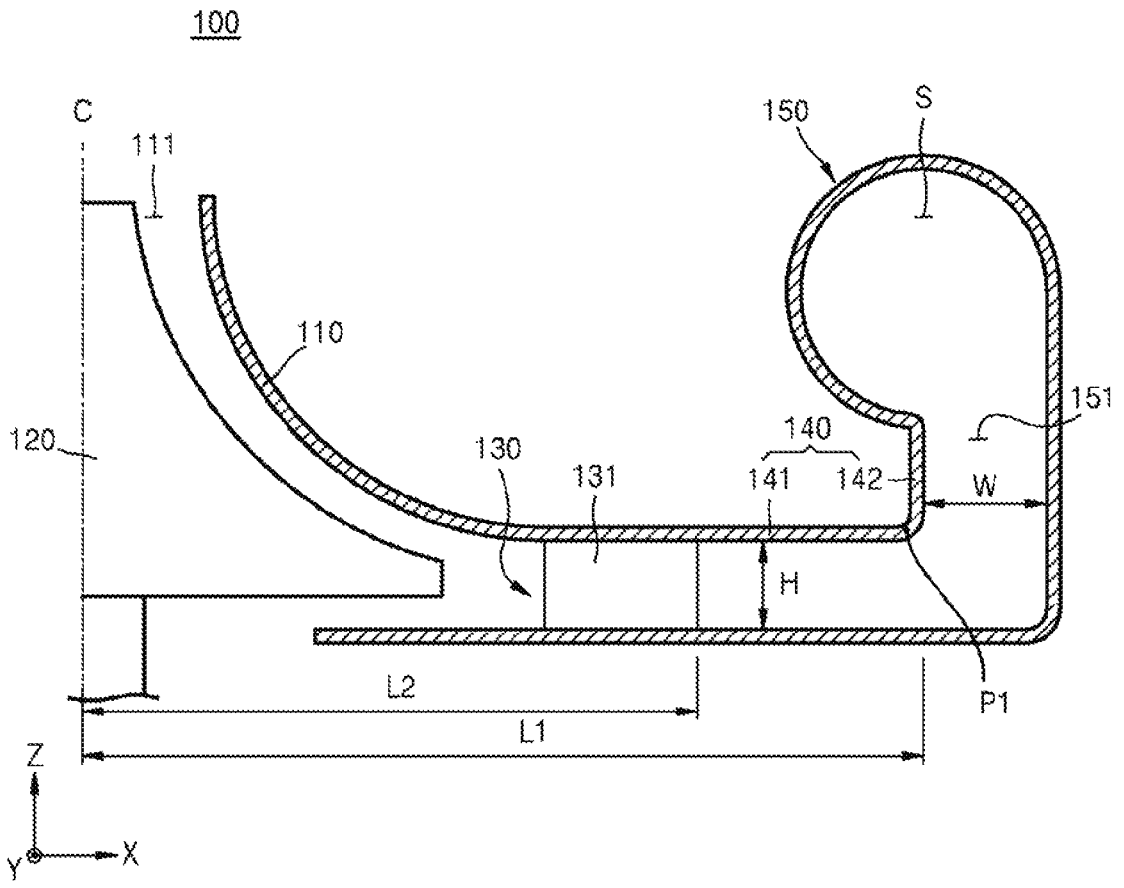
FIG. 1 is a cross-sectional view of a compressor according to an exemplary embodiment.
Figure 2:
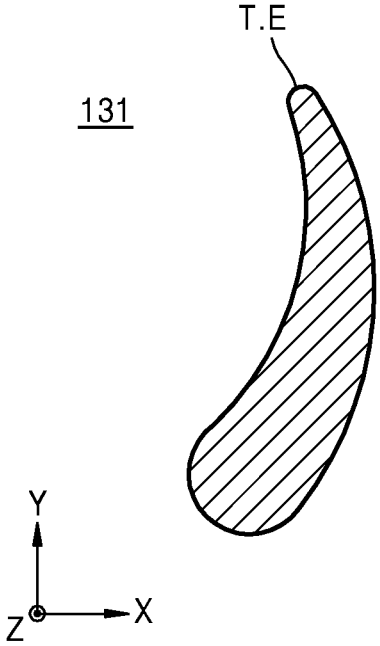
FIG. 2 is a partial cross-sectional view of the compressor of FIG. 1 showing a blade unit of a diffuser according to an exemplary embodiment.
Figure 3:
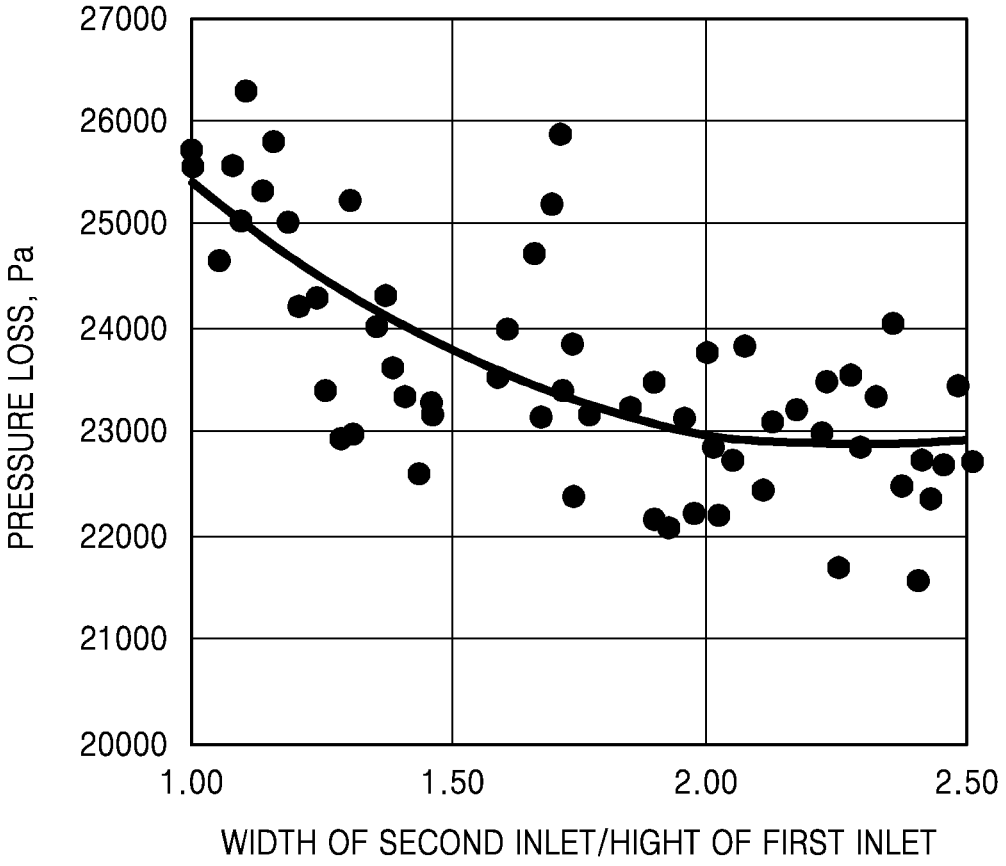
FIG. 3 is a graph for explaining pressure loss of the compressor of FIG. 1 in accordance with a size of a second length according to an exemplary embodiment.
Figure 4:
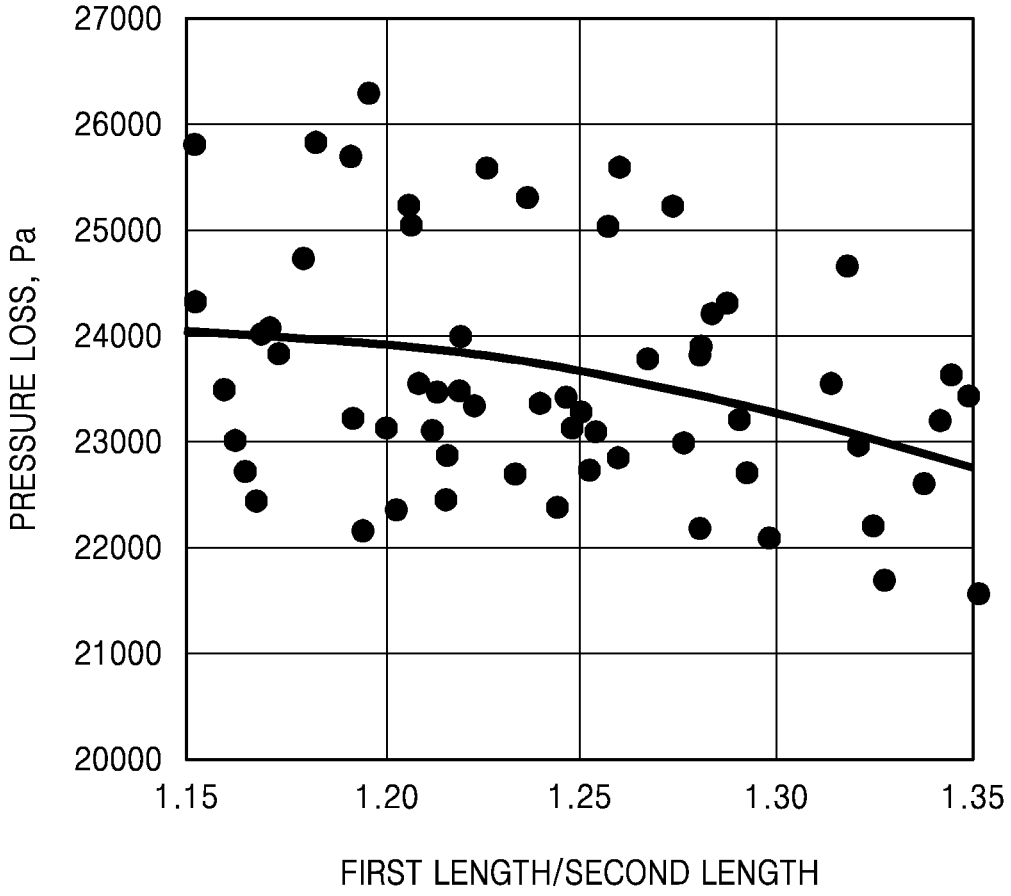
FIG. 4 is a graph for explaining pressure loss of the compressor of FIG. 1 in accordance with an entrance width of a circular space of a scroll unit according to an exemplary embodiment.

FIG. 1 is a cross-sectional view of a compressor 100 according to an exemplary embodiment, and FIG. 2 is a partial cross-sectional view of the compressor 100 of FIG. 1 showing a blade unit 131 of a diffuser 130. FIG. 3 is a graph for explaining pressure loss of the compressor 100 of FIG. 1 in accordance with a size of a second length L2, and FIG. 4 is a graph for explaining pressure loss of the compressor 100 of FIG. 1 in accordance with an entrance width of a circular space of a scroll unit 150.

Referring to FIGS. 1 to 4, the compressor 100 may include a housing 110, an impeller 120, a diffuser 130, a guidance unit 140, and the scrolling unit 150.

The housing 110 may have a circular-cone shape and may include a first inlet 111 via which a fluid enters into the compressor 100 from the outside of the compressor 100. The impeller 120 may be rotatably installed inside the housing 110.

The guidance unit 140 may be connected to the housing 110. In the exemplary embodiment, the guidance unit 140 may be formed along an outer circumference of the housing 110. Also, the guidance unit 140 may be formed in a circumferential direction of the impeller 120 from an end portion thereof.

The diffuser 130 may be installed in the guidance unit 140. In this case, the diffuser 130 and the guidance unit 140 may be integrally formed or separately formed.

The diffuser 130 may include a blade unit 131 protruding in the guidance unit 140. In the exemplary embodiment, a plurality of blade units 131 may be used, and each blade unit 131 of the plurality of blade units 131 may have an airfoil shape. The blade units 131 may be spaced apart from one another along a circumferential direction of the compressor 100.

A first length L1 which is a length from a rotation center C of the impeller 120 to a point P1 where the guidance unit 140 starts to be bent in an axial direction of the compressor 100 may be about 1.15 to about 1.3 times greater than a second length L2 which is a length from the rotation center C of the impeller 120 to a trailing edge T.E. of each blade unit 131. If the first length L1 is not greater than 1.15 times the second length L2, pressure loss of the fluid passing through the guidance unit 140 increases, and thus, performance of the compressor 100 may be degraded. Also, if the first length L1 is not less than 1.3 times the second length L2, a size of the compressor 100 greatly increases due to an increase of a size of the guidance unit 140 and thus occupies much space. As a result, manufacturing costs are increased, and the compressor 100 may not be accurately controlled.

The guidance unit 140 may be connected to the housing 110. In the exemplary embodiment, the guidance unit 140 is installed on an end portion of the housing 110 and may guide a fluid, which circulates due to the impeller 120, to flow in the circumferential and radial direction of the impeller 120 from a center of the impeller 120.

At least some portion of the guidance unit 140 may be bent. In the exemplary embodiment, the guidance unit 140 may include a first guidance unit 141 guiding the fluid in the circumferential/radial direction of the impeller 120 and a second guidance unit 142 that is connected to the first guidance unit 141 and is bent from the first guidance unit 141 in the axial direction. The first guidance unit 141 and the second guidance unit 142 may form a predetermined angle. In detail, the first guidance unit 141 and the second guidance unit 142 may form a right angle.

The fluid flowing from the guidance unit 140 to the scrolling unit 150 may undergo pressure loss. In the exemplary embodiment, the pressure loss may decrease, depending on a width W of a second inlet 151 via which the fluid enters a circular space S of the scrolling unit 150. For example, the second inlet 151 may have the width W that is about 1.5 to about 3.5 times greater than a width (or height) H of the guidance unit 140. In the exemplary embodiment, when the second inlet 151 has the width W that is not more than 1.5 times the width H of the guidance unit 140, the pressure loss increases, and thus, the performance of the compressor 100 may be degraded. Also, when the second inlet 151 has the width W that is not less than 3.5 times the width H of the guidance unit 140, the apparatus greatly increases in size and thus occupies much space. As a result, manufacturing costs increase, and the apparatus may not be accurately controlled.

The scrolling unit 150 may have the circular space S. In the exemplary embodiment, the fluid passing through the guidance unit 140 is collected in the circular space S of the scrolling unit 150 and then may be discharged to the outside of the compressor 100 or discharged to an external device.

With regard to operations of the compressor 100, the fluid entering the housing 110 according to the rotation of the impeller 120 is compressed and may be delivered to the guidance unit 140. The fluid passes through the diffuser 130 and may be delivered to the second guidance unit 142 extending and bent from the first guidance unit 141. In the exemplary embodiment, when the fluid flows from the first guidance unit 141 to the second guidance unit 142, the fluid may be provided to the scrolling unit 150 because of curvature of the guidance unit 140.

The fluid provided to the scrolling unit 150 is collected in the scrolling unit 150 and may be provided to an external device or the outside of the compressor 100. In the above-described case, the pressure loss may occur while the fluid flows from the guidance unit 140 to the scrolling unit 150. The pressure loss may result in a fast decrease of the fluid and energy consumption of the fluid, thereby degrading the performance of the compressor 100. However, the pressure loss that occurs when the fluid moves may be minimized because the compressor 100 is designed to have the above structure.

Therefore, the compressor 100 may have improved performance as well as an optimum size and shape. Also, it is not required to spend a large amount of costs to manufacture the compressor 100, and thus, production costs may be decreased.

As described above, according to the above-described exemplary embodiments, performance of a compressor may be improved.

It should be understood that the exemplary embodiments described therein should be considered in a descriptive sense only and not for purposes of limitation. Descriptions of features or aspects within each exemplary embodiment should typically be considered as available for other similar features or aspects in other exemplary embodiments.

While exemplary embodiments have been particularly shown in described above, it will be understood by those of ordinary skill in the art that various changes in form and details may be made therein without departing from the spirit and scope of the inventive concept as defined by the following claims.

What is claimed is:

1. A compressor comprising:

a housing;

an impeller rotatably installed in the housing;

a guidance unit connected to the housing at a first end of the guidance unit and configured to guide a fluid discharged by the impeller, the guidance unit configured to change a flow direction from the impeller;

a diffuser rotatably installed in the guidance unit; and a scrolling unit connected to a second end opposite to the first end of the guidance unit, wherein a width of an opening via which the fluid enters a circular space of the scrolling unit is about 1.5 to about 3.5 times a height of the guidance unit wherein a first length corresponding to a length from a rotation center of the impeller to a point where the guidance unit is bent at a radially inner wall is about 1.15 to about 1.3 times greater than a second length corresponding to a length from the rotation center of the impeller to a trailing edge of the diffuser.

2. The compressor of claim 1, wherein the width of the opening extends in a radial direction of the compressor and the height of the guidance unit extends in an axial direction of the compressor.

3. The compressor of claim 1, wherein the guidance unit comprises:

a first guidance unit extending in a radial direction; and a second guidance unit connected to the first guidance unit and extending substantially perpendicularly from the first guidance unit, the second guidance unit connected to the scrolling unit, wherein the opening corresponds to the second guidance unit and the height corresponds to the height of the first guidance unit.

4. A compressor comprising:

a housing;

an impeller rotatably installed in the housing;

a guidance unit connected to the housing at a first end of the guidance unit and configured to guide a fluid discharged by the impeller, the guidance unit configured to change a flow direction from the impeller;

a diffuser rotatably installed in the guidance unit, wherein the diffuser comprises a blade including a trailing edge; and a scrolling unit connected to a second end opposite to the first end of the guidance unit, wherein a width of an opening via which the fluid enters a circular space of the scrolling unit is about 1.5 to about 3.5 times a height of the guidance unit, wherein a first length corresponding to a length from a rotation center of the impeller to a point where the guidance unit is bent at a radially inner wall is about 1.15 to about 1.3 times greater than a second length corresponding to a length from the rotation center of the impeller to the trailing edge of the blade.

5. The compressor of claim 4, wherein the width of the opening extends in a radial direction of the compressor and the height of the guidance unit extends in an axial direction of the compressor.

6. The compressor of claim 4, wherein the guidance unit comprises:

a first guidance unit extending in a radial direction; and a second guidance unit connected to the first guidance unit and extending substantially perpendicularly from the first guidance unit, the second guidance unit connected to the scrolling unit, wherein the opening corresponds to the second guidance unit and the height corresponds to the height of the first guidance unit.

* * * * *